US005780761A

United States Patent [19]

Musante et al.

[11] Patent Number: 5,780,761

[45] Date of Patent: Jul. 14, 1998

[54] MULTI-TIERED BALLISTIC AIR HANDLING GRILLE

[75] Inventors: Ronald Eugene Musante, Los Altos; John Kenneth Orrell, Monte Sereno; David Arthur Schade, San Carlos, all of Calif.

[73] Assignee: United Defense, LP, Arlington, Va.

[21] Appl. No.: 823,429

[22] Filed: Mar. 24, 1997

[51] Int. Cl.[6] ..... F41H 7/04

[52] U.S. Cl. ..... 89/36.08; 89/36.14; 89/36.02

[58] Field of Search ..... 89/36.08, 36.13, 89/36.14, 36.07, 36.09, 36.04, 36.11, 36.02; 109/49.5

[56] References Cited

U.S. PATENT DOCUMENTS

| | | | |
|---|---|---|---|
| 2,376,331 | 5/1945 | Abrams | 89/36.08 |
| 2,397,809 | 4/1946 | Roeder et al. | 89/36.13 |
| 3,428,141 | 2/1969 | Forstner et al. | 89/36.08 |
| 3,504,644 | 4/1970 | Schibisch | 109/49.5 |
| 3,901,124 | 8/1975 | Hausenblas | 109/49.5 |
| 4,727,789 | 3/1988 | Katsanis et al. | 89/36.09 |
| 5,187,316 | 2/1993 | Hasler et al. | 89/36.02 |
| 5,641,933 | 6/1997 | Kim | 89/36.02 |

FOREIGN PATENT DOCUMENTS

| | | | |
|---|---|---|---|
| 1114410 | 9/1961 | Germany | 89/36.08 |
| 166540 | 3/1981 | Netherlands | 89/36.08 |

*Primary Examiner*—Stephen M. Johnson

*Attorney, Agent, or Firm*—Douglas W. Rudy; Michael B. K. Lee

[57] ABSTRACT

A ballistic grille structure is combined in a stacked array with a similar grille structure to yield ballistic performance capability greater than the ballistic performance capability of the original grille structure. The grille structures may be of the type currently used in single, unscathed deployments with each grille structure a truncated version of the current structure such that a synergistic projectile defeating capability is realized by the stacked array of truncated grille structures.

9 Claims, 3 Drawing Sheets

FIG. 2
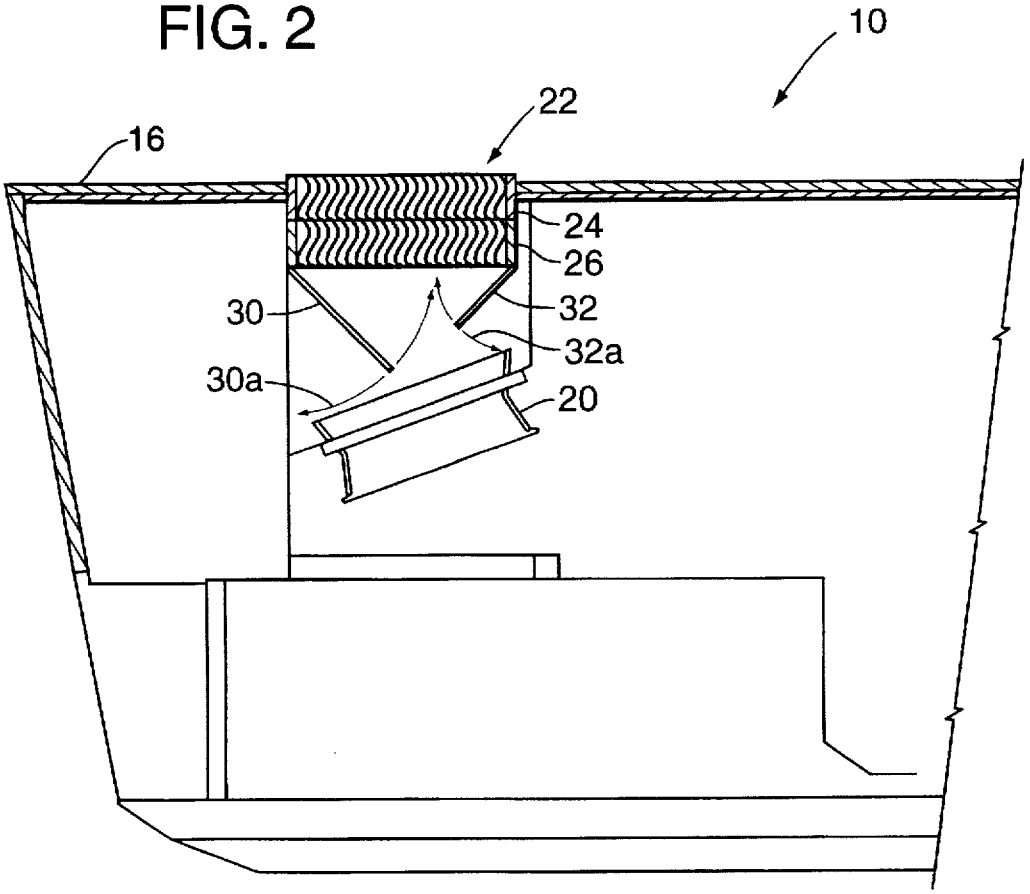
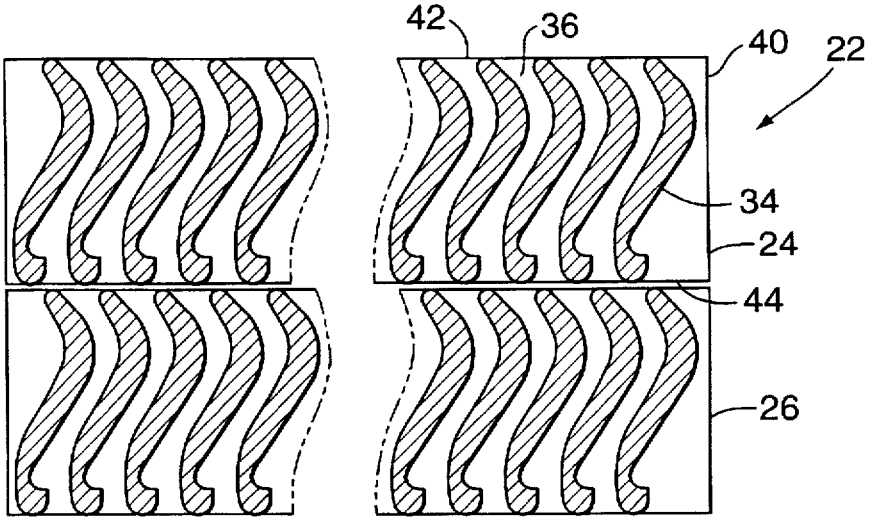
FIG. 3

MULTI-TIERED BALLISTIC AIR HANDLING GRILLE

BACKGROUND OF THE INVENTION

This invention has to do with projectile defeating and containment portal covers for use with air intakes and air exhaust portals on armored vehicles. The portal covers are multi-tiered ballistic grille structures that will pass a significant flow and volume of air while defeating the penetration of projectiles impacting the grille structures.

FIELD OF THE INVENTION

The present invention has to do with armored vehicles requiring passages through their armor system for the entry and exit of very large volumes of air into and out of the vehicle. The invention pertains to an arrangement of louvered grilles having a capacity to defeat the ingress or penetration of projectiles. Ballistic grilles are an assembly of shaped louvers mounted in a frame such that there is no straight line path from the entry side to the exit side of the louvers. Typically the louvers, referred to also as grille bars, are "chevron," serpentine, or "S-shaped." The spaces between the grille bars are approximately the same width as the thickness or width of the grille bars.

DESCRIPTION OF THE PRIOR ART

It is well known in prior art to use ballistic grilles on armored vehicles for the entry of aspiration and power train cooling air, and expulsion of spent ventilation and power train component cooling air and vehicle engine exhaust. Such grilles have been optimized to provide the same ballistic protection as the parent armor system with nominally similar area weights, i.e. per pound. Such grilles have to be optimized to provide low air pressure drops (air flow resistance) for very large quantities of air. Development of new grille configurations involves extensive air flow resistance testing and ballistic air burst shrapnel testing.

Examples of such grille structures are shown in U.S. Pat. Nos. 3,504,644, 3,428,141, 5,641,933, 2,397,809, 2,376,331, and 3,901,124, none of which show the multi-tiered ballistic grille structures as set forth in this invention wherein at least two similar grille structures are stacked one upon the other to provide an enhanced level of protection.

German patent 1114410 also shows a projectile deflecting grille structure as does a Netherlands patent 166540. Both of these patents disclose serpentine or "S-shaped" deflection bars but neither teaches the stacking of such assemblages of bars as is taught in this specification.

SUMMARY OF THE INVENTION

This invention is an adaptation of an application of using state of the art grilles to provide a level of ballistic performance beyond the capacity of such grilles. In this invention several grilles of identical design with regard to the shape of the louvers or bar components; are used, one in line with another or stacked on another, to essentially add the level ballistic protection of one grille to the level of ballistic protection of another while using the flow energy of the air to advantage in passing through the added grille tier. Ballistically, the grille bars, slats, or fins defeat projectiles by reducing their kinetic energy to a harmless level. Energy is dissipated in penetrating sections of the grille bars, and by causing the projectile to ricochet from one grille bar to another grille bar as the projectile tries to work its way through the grille.

Air flow resistance has been minimized through a combination of analytical and test techniques. The lowest air resistance grille bar shapes have been optimized from ballistically mass efficient bar shapes and spacings.

One of the objects of the invention is to overcome the very lengthy air handling grille bar optimization and ballistic protection validation expense by using a style of grille structure that is a known commodity performance-wise and stacking a second or multiple numbers of similar grille structures on top of each other or otherwise inline with each other.

One further object of the invention is to use widely used grille bar extrusions in building grille structures having a performance synergy.

BRIEF DESCRIPTION OF THE DRAWINGS

The invention is clearly set out in the drawing figures in which:

FIG. 2 is a cross sectional view of that portion of the vehicle shown in FIG. 1 that houses the grille assembly set forth herein;

FIG. 3 is a side elevation view of the ballistic grille assembly showing the placement of the tiers of grille bars;

DESCRIPTION OF THE PREFERRED EMBODIMENT

Figure 1:
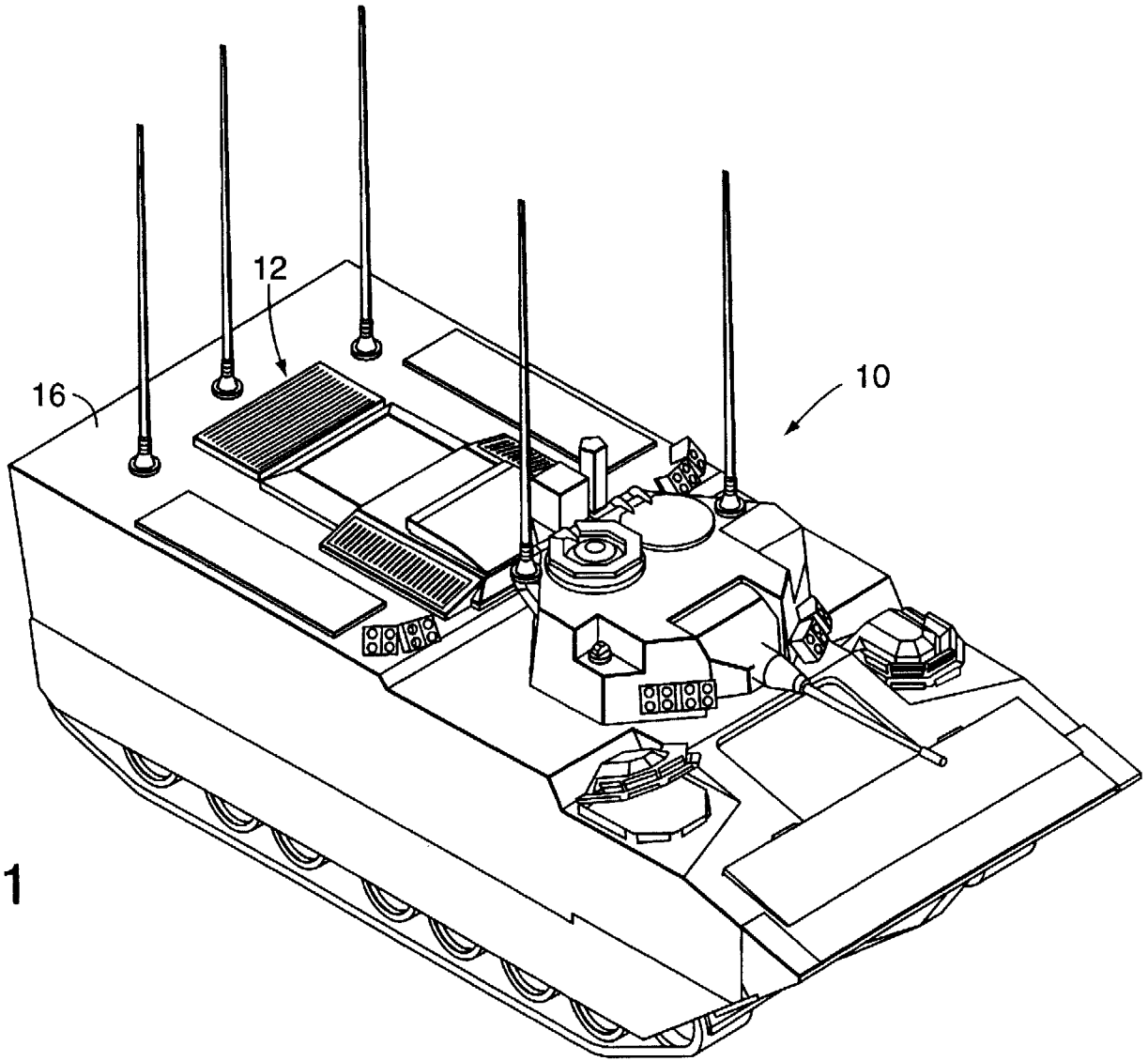
FIG. 1 is a projection view of a vehicle that incorporates the anti-ballistic grille structure of the invention.

The embodiment in which this set of projectile defeating grille bars would typically be housed is shown in FIG. 1. This is an armored vehicle having an air exhaust port that is protected from possible intrusion of projectiles from above the vehicle into the air exhaust port of the vehicle. This vehicle is designed as an amphibious vehicle and includes as part of its equipment arrangement a large air exhaust fan as shown in FIG. 2 housed below the grille structure generally 12. As can be seen the grille structure is comprised of a plurality of grille bars 14 and presents a generally flat surface opening upward on the horizontal and flat deck 16 of the host vehicle generally 10.

The FIG. 2 cross section, taken through plane 2—2 of FIG. 1 in the direction of the arrows perpendicular to the vertical plane, shows the horizontal and flat deck surface 16 of the vehicle generally 10. The large air exhaust fan shroud 20 is supported in the interior of the vehicle below the deck surface 16. The actual fan is not shown in this view however it would be mounted such that a circumferential circle described by its blades would be proximate the narrowest "necked down" portion of the fan shroud 20. In FIG. 2 the grille structure, generally 22, which is made up of a first grille structure 24 and a second grille structure 26 can be seen. Below the second, or lower grille structure 26, a pair of hinged doors, 30 and 32, are mounted to travel from a closed position adjacent the bottom surface of the second grille to an open position generally vertical so as not to interfere with air flow being driven by the fan in the fan shroud 20. The doors will swing open along the arcuate paths shown as 30*a* and 32*a*. Exhaust air flow will be generally in the direction of arrow A when the doors 30 and 32 are open and the exhaust fan is operating.

Ballistic protection of the exhaust fan is important as any significant damage to a fan blade of the exhaust fan will cause a fan imbalance and possible destruction of the fan thus negatively affecting the overall operational effectiveness of the vehicle.

The modules of grille bars, such as grille bar structure 24, is made up of the S-shaped grille bars as used on the Bradley Fighting Vehicle as manufactured by United Defense L.P. for the military of the United States of America. The S-shaped grille bars, of a metallic structure, generally an aluminum alloy, have a serpentine cross-sectional shape which has been found effective in defeating projectiles impacting grille structures made up of such S-shaped grille bars.

It is also possible that a truncated version of the full depth ballistic energy dissipation elements could be used in this invention. That is the "stock" units as used in the Bradley Fighting Vehicle could be scaled down, or otherwise truncated, in such a manner that their vertical length is made shorter. This would thus allow a shorter stacking height when, as contemplated in this invention, one tier of ballistic energy dissipation elements is stacked on top of a second tier of ballistic energy dissipation elements.

As shown in FIG. 3 the protective grille assembly generally 22 is made up of two, 24 and 26, stacked modules of grille bars each of the type used on the Bradley Fighting Vehicle. The Bradley Fighting Vehicle however does not use the stacked grilles as shown in FIG. 2 but uses only a single module such as 24 to protect against projectile intrusion.

FIG. 3 presents one embodiment of the stacked grilles. In this embodiment the first grille structure 24 has a plurality of S-shaped or serpentine grille bars such as 34 supported in a peripheral housing as represented by wall 36 and sidewall 40. Edges 42 and 44 represent the respective upper and lower edges of the wall 36 rather than covers over the grille upper surface, which could however be covered by a screen mesh or the like as a simple guard against environmental debris, such as leaves and sticks, for example, falling into the void zones between the S-shaped bars when the fan is inoperative.

The second grille structure 26 would be virtually identical to the structure of the first grille structure 24, except for necessary, as per engineering preference, hardware locations and the like, and would be located below the first grille structure 24 as shown in FIG. 3.

Figure 4:
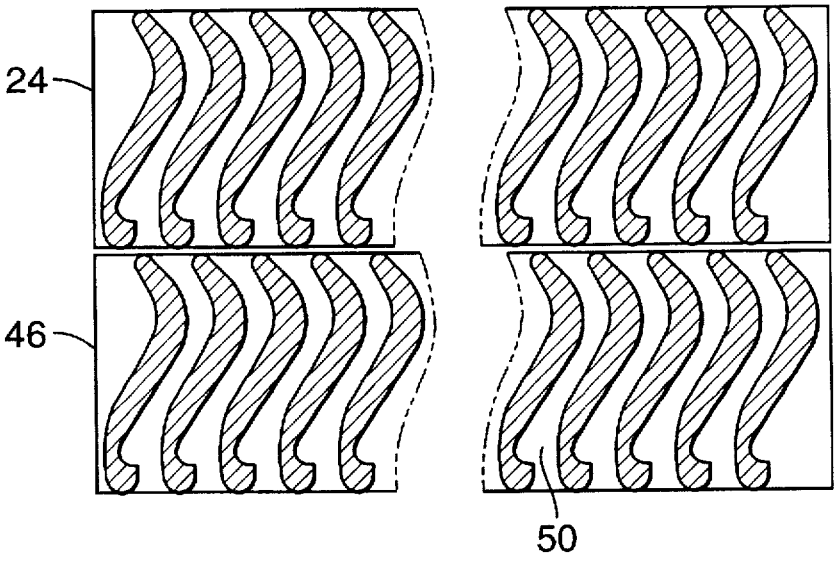
FIG. 4 shows the ballistic grille tiers and orientation of the bars of the upper and lower rows of bars with the upper set of grille bars offset with respect to the lower set of grille bars.

FIG. 4 is an alternative embodiment of the stacked first and second grille structure. In this embodiment the first grille structure will be the standard grille structure 24. The second grille structure, the offset grille structure shown as 46 has the S-shaped grille bars mounted to frame walls 50 such that when the first grille structure 24 is placed over the offset lower grille structure 46 the serpentine or S-shaped grille bars of each of the structures will not be vertically aligned as is the case in the FIG. 3 embodiment. The degree of misalignment can go from just slightly misaligned, for instance, a five percent lateral offset, to maximum misalignment wherein the centerline of the S-shaped grille bars of one set of grille bars bisects the space between the vertical centerline of a pair of adjacent S-shaped grille bars of the other set of grille bars. This could be in either a leftward or rightward, or positive or negative, relative horizontal displacement as can be easily envisioned by a person having skill in the art. For reference, the embodiment shown in FIG. 4 has the centerline of the S-shaped grille bars at maximum offset relative to the first grille structure 24 and the offset lower grille structure 46.

Figure 5:
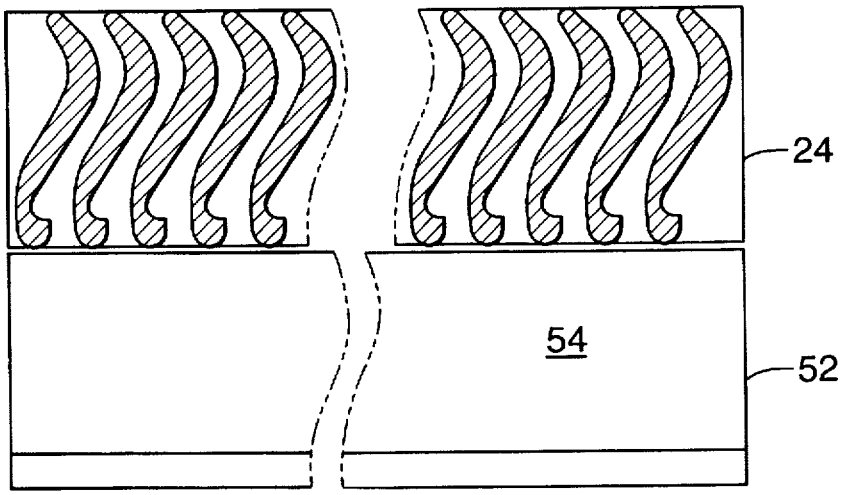
FIG. 5 shows the ballistic grille bar tiers offset a significant degree from each other.

FIG. 5 presents another embodiment of the invention. In this embodiment the first grille structure 24 is as presented in FIGS. 3 and 4. The rotated grille structure 52 shows only the face 54 of one of the S-shaped grille bars (which presumes the removal of a wall surface of a support fixture such as wall 40 of FIG. 3). In its simplest form the rotated grille structure 52 would have been rotated ninety degrees relative to the first grille structure 24. In this embodiment the first grille structure 24 will be dimensionally different, grille bar length and the number of grille bars, for instance, due to the non-square rectangular shape of the grille structure generally 12 as shown in FIG. 1. Of course if the grille structure was a square than very similar grille structures could be used, again taking into account the necessary mounting hardware considerations.

It should also be pointed out that the FIG. 5 embodiment does not require the grille bars of the first grille structure 24 be only perpendicular (in the direction of the major axis of the grille bars) to the grille bars of the rotated grille structure 54 although such a relationship is contemplated, however the sets of grille bars could be at non-perpendicular oblique angles relative to the major axis of each set of grille bars. For instance, the face 54 of the grille bar of the rotated grille structure could be on a forty-five degree angle as well as a ninety degree angle or any angle greater than zero (as shown in FIG. 1) any of which is represented by the FIG. 5 embodiment.

The preferred embodiment is a two tiered arrangement of grille bars shown in FIG. 1. The grille bar cross-section for the grille bars of each tier or grille structure are the same. The preferred embodiment mounts the bars of both sets of grille bars in a single frame, contoured to optimize the mass efficiency of the frame to defeat inbound projectiles. In summary a grille structure is provided which allows the free flow of air into or out of a vehicle. The grille structures are designed for deflecting the path of projectiles impinging on the structure and thus dissipate the energy of the projectile to a level where the projectile will not inflict serious damage to structures inboard of the grille structure, such as the fan structure mentioned above. The grille structure comprises a first tier of ballistic energy dissipation elements. These elements have a serpentine or S-shaped cross section and are aligned relative to each other to allow passage of air between the serpentine elements. A second tier of ballistic energy dissipation elements similar to the serpentine elements of the first tier are carried on the vehicle between the vehicle and the first tier of ballistic energy dissipation elements.

The foregoing description, when read in conjunction with a perusal of the drawing figures, shows how the implementation of multi-tiered ballistic air handling grille is used to meet the objects of the invention. The following claims seek to protect the inventor's idea and capture the spirit of the invention by claiming the multi-tiered ballistic air handling grille. Minor deviations and nuances of the invention are contemplated as being covered by the following claims.

What is claimed is:

1. A grille structure for allowing the free flow of air into or out of a vehicle and for deflecting the path of projectiles impinging on the structure to dissipate the energy of the projectile to a level where the projectile will not inflict serious damage to structures inboard of the grille structure, said grille structure comprising:

a first tier of ballistic energy dissipation elements, said elements having a serpentine cross section and said elements aligned relative to each other to allow passage of air between said serpentine elements;

second tier of ballistic energy dissipation elements, having a serpentine cross section identical to said serpentine cross section of said ballistic energy dissipation elements of said first tier, said ballistic energy dissipation elements of said second tier aligned relative to each other to allow passage of air between said serpentine elements of said second tier, said second tier of ballistic energy dissipation elements carried on said vehicle between said vehicle and said first tier of ballistic energy dissipation elements.

2. The invention in accordance with claim 1 wherein said first tier of ballistic energy dissipation elements have a width and said elements of said first tier are arranged with a space between each element of said first tier less than the width of the elements of said first tier.

3. The invention in accordance with claim 2 wherein said second tier of ballistic energy dissipation elements have a width and said elements of said second tier are arranged parallel to each other with a space between each element of said second tier less than the width of the elements of said second tier.

4. The invention in accordance with claim 3 wherein said first tier of ballistic dissipation elements and said second tier of ballistic elements are aligned relative to each other such that said spaces between each of the elements of the first tier of elements and the spaces between each of the elements of the second tier of elements is sufficient to allow passage of air flow through said first and said second tiers.

5. The invention in accordance with claim 4 wherein said first tier of ballistic dissipation elements and said second tier of ballistic elements are vertically aligned.

6. The invention in accordance with claim 1 wherein said second tier of ballistic energy dissipation elements have a width and said second tier elements are arranged parallel to each other with a space between each element of said second tier less than the width of the elements of said second tier.

7. The invention in accordance with claim 6 wherein said first tier of ballistic dissipation elements and said second tier of ballistic elements are aligned relative to each other such that said spaces between the elements of the first tier of elements and the spaces between the elements of the second tier of elements is sufficient to allow passage of air flow through said first and said second tiers of ballistic energy dissipation elements.

8. The invention in accordance with claim 7, wherein said first tier of ballistic dissipation elements and said second tier of ballistic elements are vertically aligned.

9. The invention in accordance with claim 7, wherein said first tier of ballistic dissipation elements and said second tier of ballistic elements are offset ninety degrees relative to each other.

* * * * *